United States Patent [19]

Campbell et al.

[11] 4,303,751

[45] Dec. 1, 1981

[54] RUPTURABLE PHOTOGRAPHIC PROCESSING ALKALINE FLUID CONTAINER

[75] Inventors: John E. Campbell, Needham; Neal F. Kelly, Woburn, both of Mass.

[73] Assignee: Polaroid Corporation, Cambridge, Mass.

[21] Appl. No.: 159,931

[22] Filed: Jun. 16, 1980

[51] Int. Cl.[3] ..... G03D 9/02

[52] U.S. Cl. ..... 430/208; 430/497; 430/449; 206/524.2; 206/524.3; 206/524.5

[58] Field of Search ..... 430/208, 497, 449, 464; 206/524.2, 524.3, 524.5

[56] References Cited

U.S. PATENT DOCUMENTS

| | | | |
|---|---|---|---|
| 2,543,181 | 2/1951 | Land | 430/208 |
| 3,056,491 | 10/1962 | Campbell | 430/208 |
| 3,056,492 | 10/1962 | Campbell | 430/208 |
| 3,173,580 | 3/1965 | Campbell | 430/208 |
| 3,649,282 | 3/1972 | Campbell | 430/208 |
| 3,833,381 | 9/1974 | Chen | 430/208 |

*Primary Examiner*—John D. Welsh

*Attorney, Agent, or Firm*—John W. Ericson

[57] ABSTRACT

A rupturable pod for storing an aqueous alkaline photographic processing composition and dispensing the composition when ruptured, comprising an adhesive, alkali resistant liner in contact with the processing composition and adhered to itself in regions forming a container enclosing the composition, and a gas and moisture barrier of metal adhered to the liner to prevent the passage of gas or moisture into or out of the container.

6 Claims, 7 Drawing Figures

RUPTURABLE PHOTOGRAPHIC PROCESSING ALKALINE FLUID CONTAINER

This invention relates to photography, and particularly to a novel fluid container for storing and dispensing aqueous alkaline photographic processing compositions.

Ruturable containers for the storage and dispensing of aqueous alkaline photographic processing compositions are shown and described in U.S. Pat. Nos. 2,543,181; 3,056,491; 3,056,492; 3,649,282; and others. Containers of this kind are employed in photographic products such as the Polaroid SX-70 film units made and sold by Polaroid Corporation of Cambridge, Massachusetts. The basic requirements of such a container are that it exclude oxygen and other environmental reagents from the processing composition, and prevent the escape of any appreciable quantity of water or other pod reagent components, until the composition is to be dispensed.

Fluid containers disclosed in the above-cited patents essentially comprise an outer layer of paper, a polyester or the like adhered to a metal foil that serves as the required gas barrier. The metal foil is adhered to a liner of a material such as polyvinyl chloride that is in contact with the processing composition and functions to prevent contact between the processing composition and the metal foil gas barrier.

Metal foils of lead, aluminum and silver have been proposed for use in containers of the kind here considered. Of these, only lead foil has previously been commonly employed. Lead is reasonably stable in the presence of aqueous alkaline compositions in the absence of oxidizing agents, such as oxygen, although pinholes in the liner must be avoided to prevent reactions that might occur over extended periods of storage. As noted in U.S. Pat. No. 3,649,282, contact between lead and the processing composition may lead to reactions producing a black product on a photographic layer processed with the composition. However, it has been found that this problem can be effectively prevented with a vinyl liner.

Aluminum foil would be a highly desirable replacement for lead foil in processing fluid containers. Aluminum is not only considerably less expensive than lead on a weight basis, but is much lighter and can be obtained in reasonably pinhole-free foils of about one-half the thickness of a lead foil with an equivalent pinhole population. However, aluminum reacts readily with aqueous alkaline compositions, forming an aluminate and gaseous hydrogen. As pointed out in U.S. Pat. No. 3,649,282, the hydrogen produced in such a reaction could cause rupture of the container. Conventional liners, of vinyl or the like, have not been found acceptable as a means of preventing this problem.

In U.S. Pat. No. 3,649,282, it is proposed to include an acid reacting layer between a foil of lead or aluminum and a vinyl liner to trap migrant alkali and prevent contact with the foil. However, this expedient has been found unnecessary with lead foil. And in view of the considerably more serious consequences of a failure with aluminum, it has not been considered sufficiently reliable.

The object of this invention is to enhance the isolation of a metallic layer in a fluid container from an aqueous alkaline composition in the container to a degree that makes negligible the probability of any reaction between alkaline components of the composition and the metallic layer.

Briefly, the above and other objects of the invention are attained by a novel fluid container comprising a metallic gas barrier, preferably of aluminum, adhered to a liner adapted to contact aqueous alkaline processing fluid in the container. The liner includes at least one layer of a polymer highly resistant to permeation by alkali. In accordance with a particular embodiment of the invention, the liner further includes a puncture resistant layer that will preclude mechanical intrusion of the metallic gas barrier onto processing fluid in the container. Preferably, an outer cover comprising paper is adhered to the metallic layer.

The invention will best be understood in the light of the following detailed description, together with the accompanying drawings, of various illustrative embodiments of the invention.

In the drawings,

FIG. 1 shows a blank 1 of one type commonly used in forming rupturable fluid containers. Except when specially made in accordance with the invention as described below, the construction as shown is also typical of the prior art as described, for example, in the above cited patents.

Figure 1:
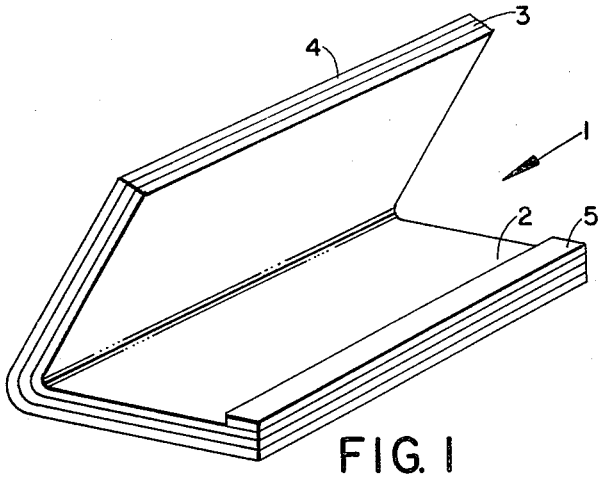
FIG. 1 is a schematic perspective sketch of a blank useful in forming a rupturable container in accordance with the invention.
Figure 2:
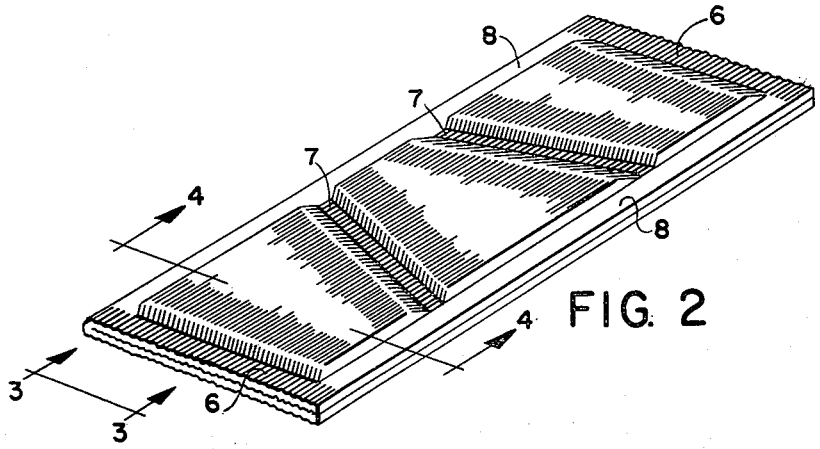
FIG. 2 is a schematic perspective sketch of a completed rupturable container made from a blank such as that shown in FIG. 1 and filled with processing composition.

In general, the blank 1 comprises a laminate including a lining 2 of material chosen to be stable in contact with the processing composition to be enclosed and to be capable of forming a liquid impermeable seal with itself, when folded over on itself as suggested in FIGS. 1 and 2, in selected regions to which heat and pressure are applied.

Adhered to the lining 2 is an intermediate metal layer 3 serving as a gas barrier to limit the exchange of gases and moisture between the inside and the outside of the finished container.

An outer cover 4 is usually adhered to the metal layer 3 for various purposes, as to contribute mechanical strength to the laminate, to impart a desired external appearance to the container, and the like.

A stripe 5 of a selected sealant is adhered to one edge of the lining 2. When the blank 1 is folded over so that the opposite edge of the lining 2 contacts the stripe 5, and heat, pressure, or both are applied, the stripe 5 serves to adhere the opposed edges of the lining 2 together to form a rupturable seal in the manner and for the purposes fully described in the above-cited patents.

As there discussed, the sealant 5 is selected to form a bond weaker than the bond formed by sealing the ends of the lining 2 together, so that pressure applied to the finished container will cause the container to open preferentially only along the edge sealed by the stripe 5. Alternatively, if so desired, the weaker seal region can be attained without the use of a stripe 5, by sealing the liner material to itself under lower temperatures and/or pressures than those used in forming the other seals.

Figure 3:
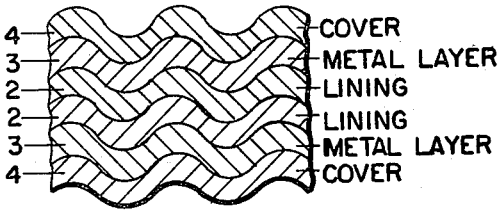
FIG. 3 is a fragmentary view, on an enlarged scale, of one end of the container of FIG. 2 as seen essentially along the lines 3—3 in FIG. 2.
Figure 4:
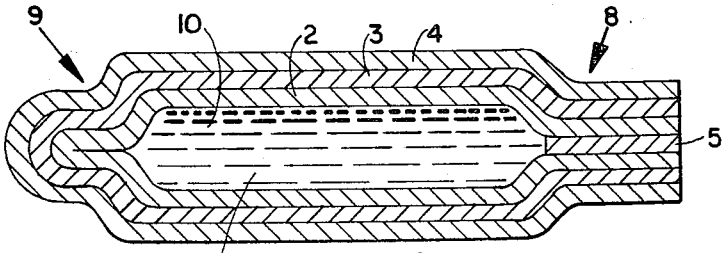
FIG. 4 is a cross-sectional view of the container of FIG. 2 taken essentially along the lines 4—4 in FIG. 2 on a verticle scale enlarged relative to the horizontal scale.

The blank 1 is folded over with the lining 2 on the inside, and sealed along edges 8 and 9 as indicated in FIGS. 2, 3 and 4. As described in U.S. Pat. No. 3,649,282, up to this stage in manufacture, the blank 1 may be part of a longer length of laminate.

The tube formed by sealing the blank along the edges 8 and 9 is next filled with aqueous alkaline processing composition 30 (FIG. 4). The container may then be closed by applying heat and pressure along the ends as indicated at 6, while crimping the edges as best shown in FIG. 3. If desired, for various purposes known to the art, such as controlling the distribution of processing composition when the container is ruptured, one or more intermediate seals, as at 7, may be formed between selected confronting regions of the lining 2. The particular arrangement of seals 7 shown in FIG. 2 corresponds to that shown and described in U.S. Pat. No. 3,833,381; such seals divide the pod into three separate compartments. In other known arrangements, communicating passages allow flow between or around the intermediate seals. The presence or absence of such intermediate seals and their location if present will be determined on the basis of considerations known to the art and not necessary to an understanding of this invention.

The overall configuration of the container so far described is typical both of the prior art and of this invention. The particular manner in which a container is constructed in accordance with the invention will next be described in conjunction with FIGS. 5–7.

Figure 5:
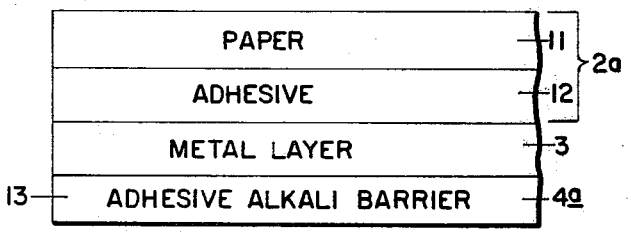
FIG. 5 is a fragmentary diagrammatic elevational sketch of a laminate useful in forming containers in accordance with one embodiment of the invention.

FIG. 5 shows a laminate in accordance with one embodiment of the invention suitable for the construction of fluid containers of the type described in connection with FIGS. 1–4. As shown, the cover 2*a* preferably comprises a sheet of paper 11, such as a tissue paper about 1 to 2 mils (around 25–55 μm) in thickness, adhered to the metal layers 3 by any suitable adhesive 12.

The paper 11 provides strength to allow the laminate to be manipulated through the various steps in the construction of the finished container. In addition, it may be selected for color; for example, a desired shade of white to match the border of a photographic product of which the container is to form a part.

The adhesive 12 may be selected from any of those known in the art for the adhesion of paper to metal, but is preferably a cross-linkable polyester adhesive such as Adcote 503A, made and sold by Morton Chemical Company, of Chicago, Ill., with a suitable catalyst added prior to application. In accordance with one embodiment of the invention, the metal layer 3 is of aluminum foil from 0.25 to 1.0 mils in thickness, and the 503A adhesive is coated on the foil in a suitable solvent such as methyl ethyl ketone. Lead foils or other metals may be used instead of aluminum, if so desired. The solvent is removed by drying, and the coated foil is laminated to the paper under heat and pressure. The adhesive is coated to a dry weight of about 3 pounds per ream (about 5 grams per square meter) in accordance with a particular and presently preferred embodiment of the invention, though lesser or greater coverages may be employed so long as adequate adhesion is obtained.

The lining 4*a* comprises a layer 13 of an adhesive alkali barrier. The alkali barrier 13 is a thermoplastic resin chosen for its ability to be adhered to the metal layer 3, to be adhered to itself, for chemical inertness in the presence of the aqueous alkaline processing composition, for its ability to form an unbroken film free of pinholes, and particularly for its ability to block the passage of aqueous alkali. A presently preferred material for this purpose is a nitrile rubber comprising a copolymer of butadiene and acrylonitrile with a relatively high ratio of acrylonitrile to butadiene, preferably applied to the metal substrate from a suitable solvent. A preferred composition is made as a solution in a suitable solvent, such as methyl ethyl ketone or other conventional nitrile rubber solvent, of a mixture of the nitrile rubber with a copolymer of a vinyl chloride and vinyl acetate modified by the addition of carboxyl groups, as by the addition of about 1 percent of maleic acid to an 86/13 weight ratio vinyl chloride/vinyl acetate monomer mixture before copolymerization. The nitrile rubber may be a non-cross-linked butadiene/acrylonitrile copolymer chosen for its alkali resistance. Particularly suitable is a copolymer of 41 parts by weight of acrylonitrile and 59 parts by weight of butadiene. The weight ratio of nitrile rubber/carboxylated vinyl may be from 25/75 to 75/25, and is preferably 50/50. A presently preferred composition is available as Bostik 4048 adhesive, as made and sold by Bostik Division, USM Corporation, of Middleton, Mass. This composition is preferably applied to the metal substrate in two solvent coats, the first of which is dried before the second is applied, to prevent pinholes. The two coats may have different ratios of nitrile rubber to carboxylated vinyl chosen for optimum properties; e.g., chemical resistance, or a preferred lower softening temperature for the coating adjacent the processing composition. Specifically, a lower ratio of nitrile rubber to carboxylated vinyl, such as 25/75, in the first coat, and a higher ratio, such as 75/15, in the second coat, would produce a layer preferentially softening on the side on which seals are made to resist penetration of the alkali barrier layer during sealing. In addition, if so desired, the second coat may include a minor amount of wax, e.g., 1 to 2 percent by weight, or a more efficient anti-blocking agent, such as fatty acid amides and the like, in amounts of 0.1 to 0.3 percent by weight, to facilitate handling of the product. Each coat may be applied to a dry coating weight of about 2 to 4 pounds per ream (around 3 to 7 grams per square meter). A single coat may be employed in the alternative constructions to be described below. The desired result in either case is a monolithic layer of a mixture of nitrile rubber and carboxylated vinyl resin in contact with the processing composition, in which the ratio of the components may vary through the layer as noted above.

Among suitable sealing materials 5 for use with the preferred nitrile rubber/carboxylated vinyl adhesive are those described in U.S. Pat. No. 3,649,282 as suitable for use with polyvinyl chloride. Alternatively, the strip 5 may be omitted and the desired differential seal attained by using different temperatures and/or pressures to effect the seals 6, 8 and 9, as described in U.S. Pat. No. 3,173,580.

Figure 6:
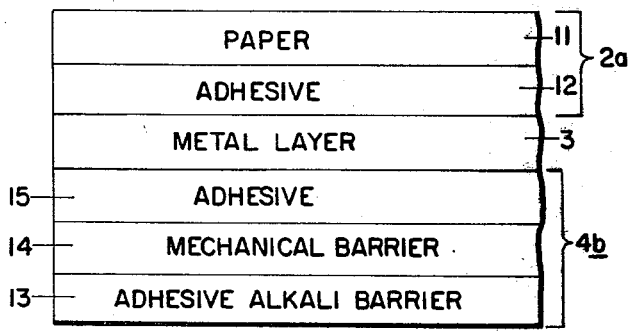
FIGS. 6 and 7 are sketches similar to that of FIG. 5 and showing other laminates useful in forming containers in accordance with other embodiments of the invention.

Referring to FIGS. 2 and 3, it will be apparent that the crimping and sealing operations employed in forming the end seals 6 and any intermediate seals 7 involve applied stresses that could conceivably result in a rupture or penetration that would carry a portion of the metal layer through the lining and possibly into direct contact with the processing composition in the container. FIG. 6 shows a laminate for forming containers in accordance with an embodiment of the invention in which this possibility is greatly minimized, if not altogether prevented.

Referring to FIG. 6, the outer layers of the laminate, comprising the paper layer 11, its adhesive 12, the metal layer 3 and the adhesive alkali barrier layer 13, may be as described above in conjunction with FIG. 5. In FIG. 6, however, a mechanical barrier layer 14 of tough, resilient material resistant to puncture, shock and flow is interposed between the metal layer 3 and the adhesive alkali barrier 13. The barrier layer 14 may be adhered to the metal layer 3 by any suitable conventional adhesive 15.

The barrier layer 14 is preferably of a polyester such as polyethylene terephthalate, on the order of 0.25 to 0.75 mils (about 12.7 μm) in thickness. Among other suitable materials are oriented polypropylene, nylon and polyethylene. Polyethylene is particularly desirable for its resistance to aqueous alkali. The barrier layer should be infusible at the temperatures and/or pressures used in forming and sealing the container, to prevent portions of it from squeezing out to permit contact between the alkaline processing composition and the metal, or to allow the barrier layer to become so thin as to permit the flow or diffusion of reactive components of the composition into contact with the metal.

The adhesive 15 may be chosen for its adhesion both to the metal layer 3 and to the mechanical barrier 14, for which purposes a cross-linked polyester such as Adcote 503A is well suited where the metal layer is of aluminum foil and the mechanical barrier is polyethylene terephthalate. Preferably, the adhesive 15 is of the same alkali barrier material as the barrier 13, except that the barrier 13 preferably includes an antiblocking agent as noted above, which would serve no purpose in the adhesive layer 15.

Additional peel strength, or resistance to delamination, between the mechanical barrier 14 and adjacent structure may be provided by including a thin primer coat, e.g., 1 to 3 μm, of an adhesive chosen primarily for its adhesion to the mechanical barrier 14 and to the adjacent layers 13 and 15. For example, if the mechanical barrier layer is of polyethylene terephthalate, and the adhesive layers 13 and 15 are of a nitrile rubber-carboxylated vinyl composition, a primer coat of a cross-linkable polyester, such as Adcote 1069, as made and sold by Morton Chemical Company of Chicago, Illinois, on both surfaces of the layer 14 will materially increase adhesion. A catalyst is added to this material prior to coating in accordance with the manufacturer's instructions.

Figure 7:
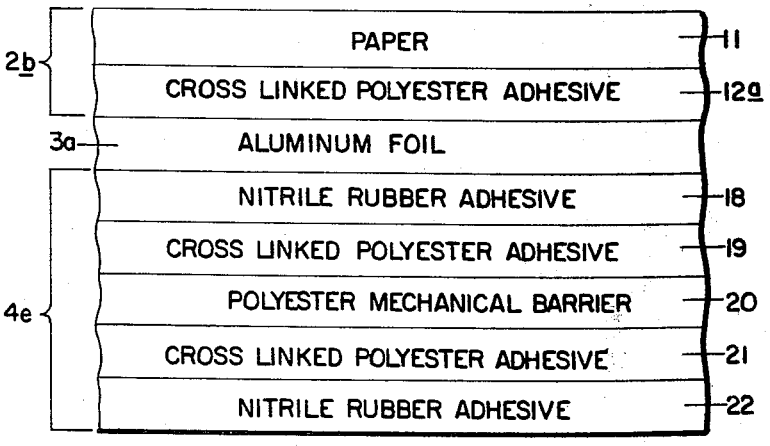

FIG. 7 shows a laminate presently preferred for its high strength, alkali resistance, and resistance to delamination or puncture. The several layers of the structure may be as described above. The method presently contemplated for the manufacture of the laminate of FIG. 8 is as next described.

In a particular and presently preferred embodiment, a 0.5 mil sheet of polyethylene terephthalate, shown at 20 in FIG. 8, is coated with a solution of Adcote 1069 polyester adhesive in methyl ethyl ketone, to a dry coating weight of 1 to 2 pounds per ream, and dried to remove the solvent. The layer 19 of adhesive primer is next coated with a solution of Bostik 4048 nitrile rubber adhesive in methyl ethyl ketone to a dry coating weight of 4 pounds per ream, and dried to remove the solvent. A sheet of aluminum foil 3*a*, 0.5 mils in thickness, is then laminated under heat and pressure to the adhesive layer 18 of the laminate 20, 19, 18, accelerating the cross-linking of the polyester adhesive layer 19 in the process. Next, a coating 12*a* of 3 pounds per ream of Adcoate 503A adhesive is applied from a solvent solution as described above, and laminated under heat and pressure to a 1.2 mil sheet of white tissue paper 11, removing the solvent and accelerating the cure of the adhesive 12*a* in the process.

The laminate 11, 12*a*, 18, 19, 20 is now solvent coated with a priming layer 21 of Adcote 1069 polyester adhesive and dried to remove the solvent. A dried coating weight of 1 to 2 pounds per ream is adequate. Over the layer 21 is solvent coated a layer 22 of the same nitrile rubber adhesive used to form the layer 18 to a dry coating weight of 4 pounds per ream, and dried to remove the solvent.

While the invention has been described with reference to the details of various specific illustrative embodiments, many changes and variations will occur to those skilled in the art upon reading this description, and such can be made without departing from the scope of the invention.

Having thus described the invention, what is claimed is:

1. A photographic product comprising a rupturable container holding an aqueous alkaline photographic processing composition, said container comprising a laminar pouch having a lining in contact with said processing composition, a layer of aluminum foil adhered to said lining, and a paper cover adhered to said aluminum foil, said lining comprising a monolithic layer of a mixture of nitrile rubber and a carboxylated vinyl resin in contact with said processing composition.

2. A photographic product comprising a rupturable container holding an aqueous alkaline photographic processing composition, said container comprising a laminar pouch having a lining in contact with said processing composition, a layer of aluminum foil adhered to said lining, and a paper cover adhered to said aluminum foil, said lining comprising a monolithic layer in contact with said processing composition of a mixture of polymers consisting essentially of from 25 to 75 parts by weight of nitrile rubber per 100 parts by weight of polymers and the balance of a carboxylated vinyl resin.

3. A photographic product comprising a rupturable container holding an aqueous alkaline photographic processing composition, said container comprising a laminar pouch having a lining in contact with said processing composition, and a layer of aluminum foil adhered to said lining, said lining comprising a monolithic layer of a mixture of nitrile rubber and a carboxylated vinyl resin in contact with said processing composition.

4. A photographic product comprising a rupturable container holding an aqueous alkaline photographic processing composition, said container comprising a laminar pouch having a lining in contact with said processing composition, and a layer of metal foil adhered to said lining, said lining comprising a monolithic layer in contact with said processing composition of a mixture of polymers consisting essentially of from 25 to 75 parts by weight of nitrile rubber per 100 parts by weight of polymers and the balance of a carboxylated vinyl resin.

5. A photographic product comprising a rupturable container holding an aqueous alkaline photographic processing composition, said container comprising a laminar pouch having a lining in contact with said processing composition, a layer of aluminum foil adhered to said lining, and a paper cover adhered to said aluminum foil, said lining comprising a monolithic layer comprising nitrile rubber in contact with said processing composition.

6. A photographic product comprising a rupturable container holding an aqueous alkaline photographic processing composition, said container comprising a laminar pouch having a lining in contact with said processing composition, and a layer of aluminum foil adhered to said lining, said lining consisting essentially of a monolithic layer of nitrile rubber containing a minor amount of an anti-blocking agent.

* * * * *